US006619496B2

(12) United States Patent
Appelbaum

(10) Patent No.: US 6,619,496 B2
(45) Date of Patent: Sep. 16, 2003

(54) PACKAGE WITH SNAG-LOCK HINGED SIDES

(76) Inventor: Paul Appelbaum, 16371 Wimbledon La., Huntington Beach, CA (US) 92649

( * ) Notice: Subject to any disclaimer, the term of this patent is extended or adjusted under 35 U.S.C. 154(b) by 0 days.

(21) Appl. No.: 10/024,022

(22) Filed: Dec. 21, 2001

(65) Prior Publication Data

US 2003/0116563 A1 Jun. 26, 2003

(51) Int. Cl.[7] ..... B65D 6/18
(52) U.S. Cl. ..... 220/7; 220/359.1; 220/802
(58) Field of Search ..... 220/6, 7, 4.28, 220/1.5, 359.1, 612, 613, 801, 790, 802, 792, 359.2

(56) References Cited

U.S. PATENT DOCUMENTS 3,108,710 A * 10/1963 Lange et al. ..... 220/613
3,756,393 A * 9/1973 Markwitz et al. ..... 206/456
4,005,795 A * 2/1977 Mikkelsen et al. ..... 220/7
4,170,313 A * 10/1979 Caves et al. ..... 220/7
4,235,346 A * 11/1980 Liggett ..... 220/7
4,935,735 A * 6/1990 DeLuca et al. ..... 340/7.58
4,984,688 A * 1/1991 Mikulin ..... 206/455
5,425,453 A * 6/1995 Dirx ..... 206/455
5,532,044 A * 7/1996 Jen ..... 428/167

* cited by examiner

*Primary Examiner*—Nathan J. Newhouse
*Assistant Examiner*—Joseph C. Merek

(57) ABSTRACT

A clear plastic package has an upper piece and a lower piece, each piece having a generally rectangular configuration, and the lower piece having front and rear edge portions, and opposing side edge portions. Along each edge portion of the lower piece there is a pivotable wall attached by way of a living hinge, and these walls can be rotated from a generally horizontal position to an upright position relative to the lower piece, and there is a longitudinally extending locking edge on a lower part of each wall that resiliently snaps into engagement with a cooperating fixed edge on a projection that extends longitudinally along the perimeter of the lower piece, when the walls are rotated to their upright positions, to hold the walls in their upright positions. The upper portion of each of the walls is so shaped that when they are in upright position, they cooperate to provide a recessed ledge. Extending along the perimeter of the upper piece is a downwardly projecting rib that is received within the recessed ledge of the lower piece, and adhesively secured therein to form a sealed enclosure for an article.

6 Claims, 2 Drawing Sheets

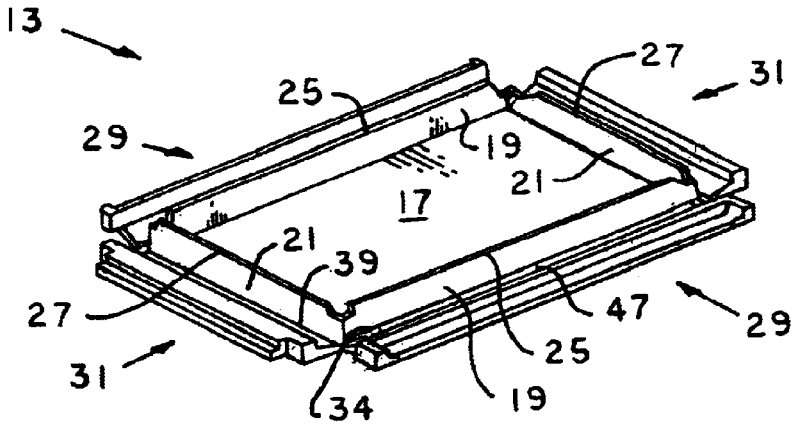
Fig. 1
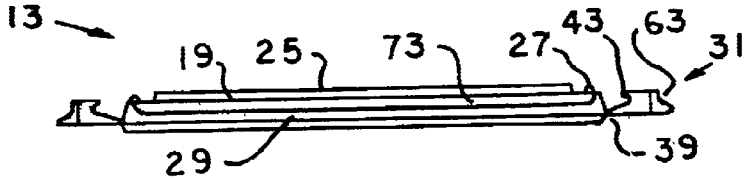
Fig. 2
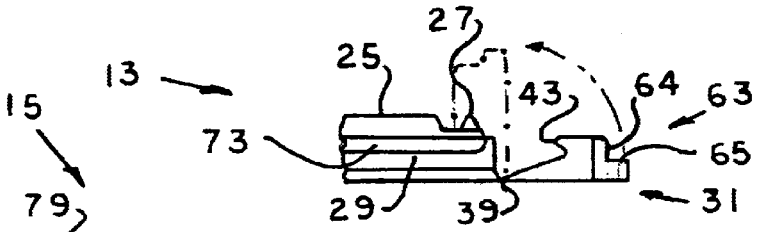
Fig. 3
Fig. 6
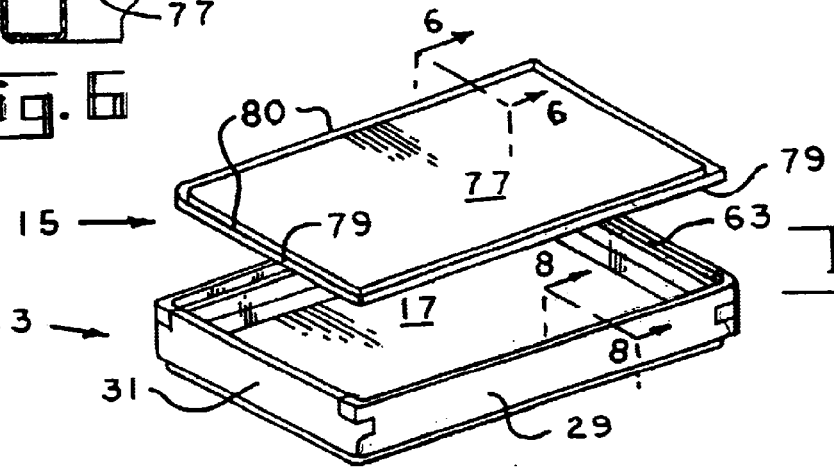
Fig. 5

PACKAGE WITH SNAG-LOCK HINGED SIDES

BACKGROUND OF THE INVENTION

1. Field of the Invention

The present invention relates generally to clear, plastic clamshell type packages for relatively small articles, and more particularly to a two-piece package with a bottom piece with hinged sidewalls.

2. Description of the Prior Art

Clear plastic packages are popular for enclosing small articles of commerce and have undergone advancements over the years. Nonetheless there remains a need for improvements in several aspects of such packages. For example there is need for packages that present a greater resistance to those who would pilfer, tamper with, or otherwise break into a package and remove its contents. There is also an unfilled need for clamshell type packages that have a low profile for efficient storage. It is also noted that prior clamshell type packages in their assembled form are not self-supporting on a flat surface.

SUMMARY OF THE INVENTION

In view of the foregoing, it is a general object of the present invention to provide a clear plastic package that has an improved level of security against pilferage and tampering.

Another object is to provide a clear plastic clamshell type package whose components have a relatively low profile in their unassembled configuration and which in its assembled configuration is strong and stable, while displaying all sides of an enclosed article in a highly aesthetic manner.

A further object is to provide such a package that can be self-supporting on any of its sides on a level surface, for display and other purposes.

These and other objects and advantages are achievable by the present invention, which is a clear plastic package that has a generally rectangular upper piece and lower piece, the upper piece having a major surface with a downwardly extending rib extending along the perimeter of the major surface.

The lower piece has a major surface and front, rear and opposing side edge portions, and to each edge portion there is hindgedly connected a wall that can rotate from a generally horizontal position to an upright position relative to the major surface. On a lower part of each wall, spaced from the hinge, and extending longitudinally, is a resiliently deformable locking edge portion. Adjacent to each of the side edge portions of the lower piece is a fixed upward projection that is adapted to snap into resilient locking engagement with the locking edge portion of each upwardly rotated wall to hold it in upright position. In a preferred embodiment the adjacent side edges of the walls are shaped so as to intermesh, and there is means on the intermeshing side edges for making resilient snapping locking engagement between them. The outer sides of each of the four walls are shaped such that the assembled package can stand on any of its sides.

The upper edge portions of the walls are so shaped that when they are in upright position they will cooperate to provide a recessed ledge for receiving the perimeter rib of the upper piece, which rib can be adhesively secured to the recessed portion to provide a sealed enclosure for an article. The upper edge of the installed perimeter rib is adapted to lie flush or below the top of the recessed ledge, and thus provides a neat package with clean lines and without an exposed flange that could be the target of efforts to pry apart an edge of the sealed package.

Thus there is provided a strong, clear plastic packager that can lie flat for storage and stand upright on one of its sides for display purposes.

The present invention will be further appreciated in view of the drawings, detailed description, and claims, which follow.

BRIEF DESCRIPTION OF THE DRAWINGS

FIG. 1 is a perspective view of the lower piece of a package according to a preferred embodiment of the present invention, the walls of the piece being in lowered position;

FIG. 2 is a side elevational view of the piece shown in FIG. 1;

FIG. 3 is an enlarged partial elevational view of the piece shown in FIG. 2;

FIG. 5 is an exploded perspective view of the upper piece and the assembled lower piece of a package according to the present invention;

FIG. 6 is an enlarged sectional view taken along the line 6—6 of FIG. 5;

DETAILED DESCRIPTION OF THE INVENTION

Figure 8:
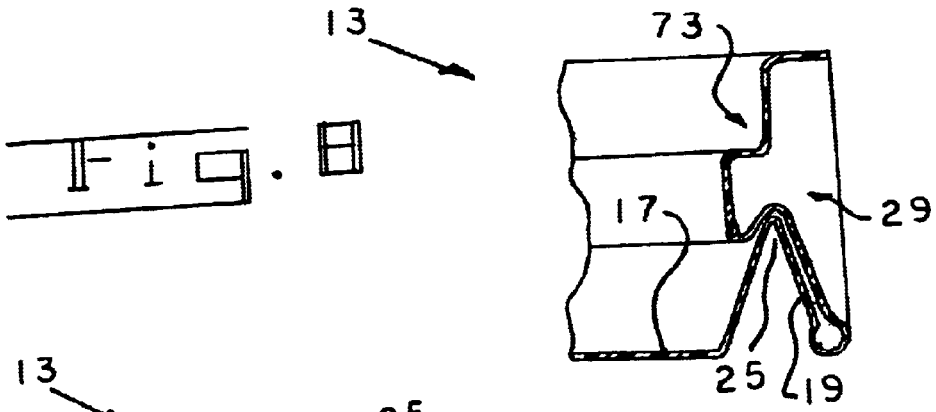
FIG. 8 is an enlarged sectional view taken along the line 8—8 of FIG. 5.

Referring now to the drawings, FIGS. 1 and 5 show that a preferred embodiment of the invention is comprised of a lower piece 13 and an upper piece 15, molded of a suitable clear plastic material using conventional injection molding techniques. FIG. 1 best shows how the lower piece 13 has a major bottom surface 17 that is bounded on opposing sides by fixed, inner locking walls 19 and 21 respectively. Their longitudinally extending edges 25 and 27 will serve as locking edges for making resilient snap-lock engagement with structure on the hinged walls of the invention, in a manner to be described. The lower piece 13 further features opposing hinged walls 29 and 31 respectively which are connected to the lower periphery of the inner locking walls by so-called living hinges 34 and 39 respectively. A better view of hinge location 39 is given in FIGS. 2 and 3 which also shows that wall 31 provides a locking edge 43. The locking edge 43 is designed to make resilient snap engagement with the fixed locking edge 27 when the wall 31 is rotated upwardly from the position shown in FIGS. 2 and 3, as will be described. Similarly there are locking edges 47 on the walls 29 that will make "snap-over" lock engagement with the fixed edges 25 when walls 29 are rotated to their upright positions. FIG. 3 best illustrates, in broken lines, the upwardly rotated and locked position of the walls 31.

Figure 4:
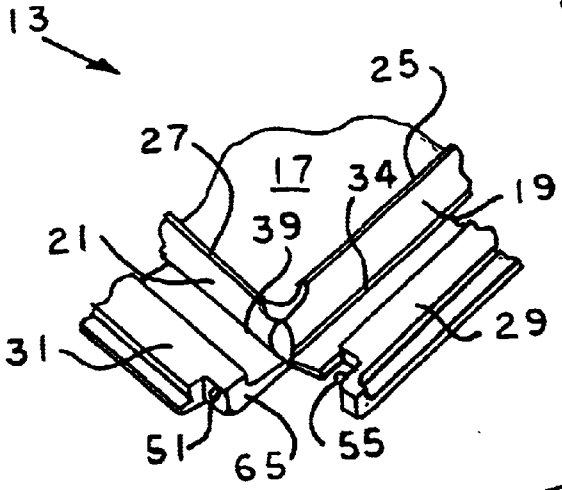
FIG. 4 is an enlarged, partial, perspective view of a corner region of the package lower piece, showing interlocking features.
Figure 7:
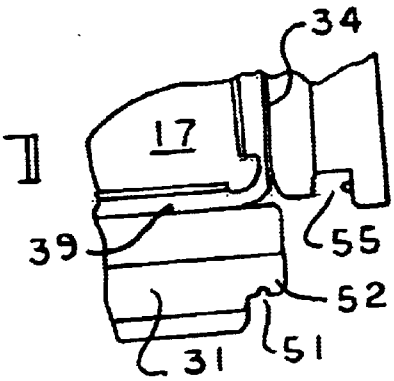
FIG. 7 is a partial, enlarged plan view, similar to FIG. 4.

In addition to the above-described snap-over engagements there is interlocking engagement between all four walls when they are in upright position by virtue of the shaping of the respective adjoining side edges. The enlarged views of FIGS. 4 and 7 show that the side edge of wall 31 has depression 51 which will be seen to be engaged by the detent 55 which projects from the surface 57 on the shaped side edge of the wall 29. The other three corner regions formed by adjacent walls of the lower piece 13 are similarly constructed. When wall 31 and wall 29 are rotated to their upward positions they intermesh and interlock, i.e. the recess at 63 in the side edge of wall 29 will receive the sidewardly projecting portion 65 of the adjacent wall 31, and the detent 55 will resiliently snap into holding engagement with depression 51 on the surface 52.

Finally it is noted in FIGS. 2 and 3 that the upper edge of the walls 31 are shaped with a ledge 63 comprised of surfaces 64 and 65. Similarly the upper edges of walls 29 are provided with the ledge 73 as best shown in FIG. 8.Thus when all four walls are held in their upright positions as FIG. 5 illustrates, the four ledge portions cooperate to provide a single recessed ledge along the uppermost part of the piece 13.

The upper piece 15 shown in FIG. 5 has a major surface 77 and features a perimeter rib 79 that projects downwardly from the major surface as also shown in FIG. 6. As can be appreciated from FIG. 5 the afore-described rib 79 is sized so as to be snugly received in the recessed ledge of the assembled lower piece 13 whereby the upper piece 15 covers the open top of the lower piece. In the preferred embodiment here-shown, the perimeter rib 79 is without a flange, and its top edge 80 will lie below the top of the ledges 63 and 73. Thus there is no easy way to pry open the resulting connection.

The design lends itself to the use of UV (ultraviolet light) curable adhesive whereby adhesive is applied to rib 79, which is then placed in the recessed ledge of lower piece 13. Illumination in a suitable UV chamber will instantly cure the adhesive to result in a package that is strong and well sealed against tampering.

Figure 9:
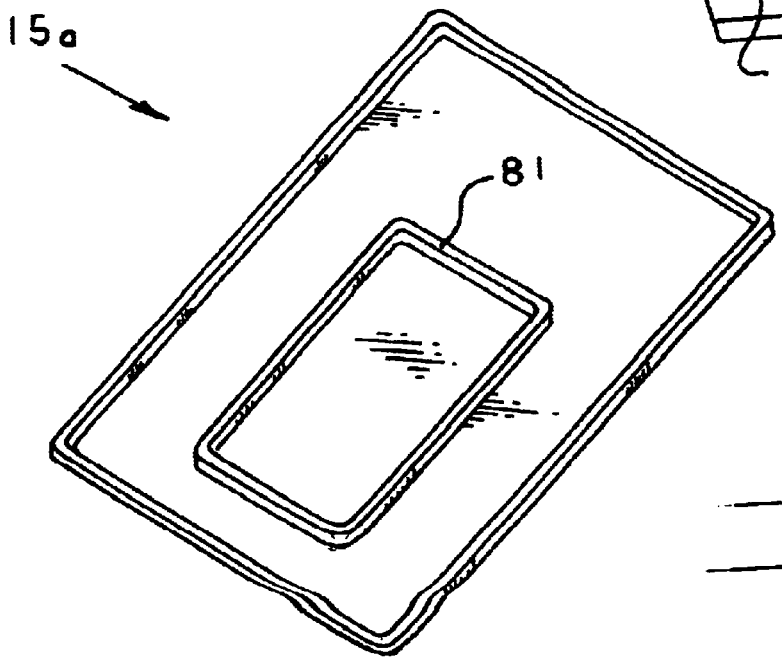
FIG. 9 is a perspective view of the inverted upper piece of a variant of the present invention.

In a variant of the present invention, shown inverted in FIG. 9, there is an upper piece 15*a* similar to piece 15 except for the inclusion of four-sided ribbed portion 81 for receiving and stabilizing an upper part of a rectangular article of commerce. A similar ribbed enclosure is formed in the corresponding location of the package bottom piece to receive and hold the lower portion of the article.

While particular embodiments of the invention have been shown, it is not intended that the invention be limited thereto. Various modifications and variations of the invention will be evident to persons of ordinary skill in the art, given the benefit of this disclosure, and it is intended that the invention be given its full scope and breath as defined in the claims that follow.

What is claimed is:

1. A plastic package for enclosing an article, including:

a) a generally rectangular upper piece having a downwardly projecting rib member extending along its perimeter;

b) a generally rectangular lower piece having a major bottom surface and an inner locking wall extending longitudinally on a front, rear and each of opposing sides of said bottom surface, each locking wall having an outer edge portion; and a hinged wall connected respectively to each said outer edge portions and being rotatable from a generally horizontal position to an upright position, and a preformed locking edge extending along a lower part of each said hinged walls for making resilient locking engagement with said locking wall when said hinge wall is rotated to its upright position, so as to hold said wall upright; and wherein upper edges of said upright hinged walls are adapted to receive the rib of said upper piece and to be adhesively secured thereto to complete the package; and wherein the upper edge portion of each said hinged walls has a recessed ledge which is adapted for receiving the perimeter rib of said upper piece, and wherein said recessed ledge has a generally horizontal surface and a generally vertical surface, and said perimeter rib has an outer edge that is adapted to lie below top of said vertical surface when said rib is received in said recessed ledge.

2. A package as defined in claim 1 wherein the side edges of each of said hinged walls is shaped so as to intermesh with side edges of an adjoining wall when the hinged walls are in upright positions.

3. A package as defined in claim 2 wherein the side edges of each of said hinged walls is shaped so as to intermesh with side edges of an adjoining wall when the hinged walls are in upright positions.

4. A package as defined in claim 4 wherein there is means on the intermesh portions of one of said hinged walls for resiliently snapping into locking engagement with corresponding means on the side edge of an adjacent hinged wall.

5. A package as defined in claim 1 wherein there is a longitudinally extending edge on the upper part of each said inner walls that is adapted for making resilient locking engagement with the locking edge on said hinged wall.

6. A package as defined in claim 1 wherein there is a longitudinally extending edge on the upper part of each said inner walls that is adapted for making resilient locking engagement with the locking edge on said hinged wall.

* * * * *